US009347189B2

(12) United States Patent
Eccless et al.

(10) Patent No.: US 9,347,189 B2
(45) Date of Patent: May 24, 2016

(54) SAFETY CONE CAUTION TAPE HOLDER

(71) Applicants: David Eccless, Clearwater, MN (US); Lyle Collver, Monticello, MN (US)

(72) Inventors: David Eccless, Clearwater, MN (US); Lyle Collver, Monticello, MN (US)

( * ) Notice: Subject to any disclaimer, the term of this patent is extended or adjusted under 35 U.S.C. 154(b) by 347 days.

(21) Appl. No.: 13/855,943

(22) Filed: Apr. 3, 2013

(65) Prior Publication Data

US 2013/0333610 A1 Dec. 19, 2013

Related U.S. Application Data

(60) Provisional application No. 61/661,480, filed on Jun. 19, 2012.

(51) Int. Cl.
*E01F 9/012* (2006.01)
*E01F 13/02* (2006.01)

(52) U.S. Cl.
CPC ..... *E01F 9/0122* (2013.01); *E01F 13/028* (2013.01)

(58) Field of Classification Search
CPC ..... E01F 9/012; E01F 9/0122; E01F 13/02; E01F 13/022; E01F 13/028
USPC ..... 116/63 C, 63 P; 40/612; 404/6, 9, 10
See application file for complete search history.

(56) References Cited

U.S. PATENT DOCUMENTS

| | | | | | |
|---|---|---|---|---|---|
| 2,002,756 | A | * | 5/1935 | Segelhorst | 116/63 P |
| 2,762,328 | A | | 9/1956 | Weig | |
| 3,380,428 | A | | 4/1968 | Abrams | |
| 4,197,808 | A | | 4/1980 | Kinninger | |
| D264,011 | S | * | 4/1982 | Genoa | D32/31 |
| 5,036,791 | A | | 8/1991 | Thurston | |
| 5,195,453 | A | | 3/1993 | McGibbon, II | |
| 5,269,251 | A | * | 12/1993 | Freeman | 116/63 C |
| 5,467,548 | A | | 11/1995 | Ross | |
| 5,749,673 | A | | 5/1998 | Kulp et al. | |
| 6,053,657 | A | * | 4/2000 | Signorelli | 404/6 |
| 6,095,716 | A | | 8/2000 | Kulp et al. | |
| 6,186,699 | B1 | | 2/2001 | Kulp et al. | |
| 6,199,504 | B1 | * | 3/2001 | Freeman | 116/63 C |
| 6,305,312 | B1 | | 10/2001 | Bent et al. | |
| 6,536,369 | B1 | | 3/2003 | Bent et al. | |
| 6,769,380 | B1 | * | 8/2004 | Carvajalino et al. | 116/63 P |
| D597,432 | S | * | 8/2009 | Auberger | D10/113.2 |

(Continued)

FOREIGN PATENT DOCUMENTS

| | | | | | |
|---|---|---|---|---|---|
| FR | 2997971 | A1 | * | 5/2014 | E01F 9/012 |
| GB | 2214209 | B | * | 1/1992 | E01F 9/012 |
| JP | 2003301428 | A | * | 10/2003 | E01F 13/02 |

(Continued)

*Primary Examiner* — R. A. Smith
(74) *Attorney, Agent, or Firm* — Buckingham, Doolittle & Burroughs, LLC

(57) ABSTRACT

A caution tape holder for removable attaching a length of caution tape to a prior art safety cone. The caution tape holder is comprised of a top portion and a body portion, wherein said top portion extends at least partially out of an opening in a safety cone and has an opening therein for receipt of a length of caution tape. The caution tape holder of the present invention can be used in conjunction with a variety of different sized safety cones and will not damage the safety cone or the length of caution tape used therewith, nor does it necessitate the threading of the tape through a narrow opening. Additionally, the caution tape holder will not unduly interfere with the stacking and storage of prior art safety cones in a nesting fashion.

14 Claims, 6 Drawing Sheets

(56) References Cited

U.S. PATENT DOCUMENTS

2011/0220010 A1 9/2011 Klein et al.
2012/0076970 A1* 3/2012 Suter ..... E01F 13/028
428/80

FOREIGN PATENT DOCUMENTS

JP 2006144410 A * 6/2006 ..... E01F 13/02
JP 2006193963 A * 7/2006 ..... E01F 13/02

* cited by examiner

SAFETY CONE CAUTION TAPE HOLDER

CROSS-REFERENCE

This application claims priority from Provisional Patent Application Ser. No. 61/661,480 filed on Jun. 19, 2012.

FIELD OF THE INVENTION

This invention relates to a caution tape holder that can be inserted into an opening in a prior art safety cone or other object for retaining the tape above the cone and establishing a safety zone. The unique design and profile of the caution tape holder does not damage the caution tape or the safety cone, and permits the safety cones to be stacked on top of one another in a nested fashion for storage with the caution tape holder installed thereon.

BACKGROUND

Oftentimes it is necessary for workers and/or first responders to establish a safety or work zone to complete the task at hand. The creation of such a temporary safety and/or work zone is typically accomplished through a combination of safety cones and caution tape. More specifically, the safety cones are placed along the perimeter of the safety/work zone and strung together using caution tape. For example, when it is desirable to divert traffic or otherwise block off a designated construction zone, construction workers will typically place safety cones along the perimeter of the area being cordoned off and string said cones together with caution tape. Typically, the caution tape is tied or stapled to the cones, which is not only time consuming to install/de-install but also tends to damage the tape and/or cones so that they cannot be reused.

Consequently, there exists in the art a long-felt need for a device for removably attaching caution tape or other items, such as warning flags, to a safety cone, traffic barrel, etc. There also exists in the art a long felt need for a caution tape holder that does not cause damage to the caution tape or to the object to which it is attached, thereby enabling the reuse of said items. Moreover, there is a long felt need for a caution tape holder for removable attachment to a safety cone, wherein a plurality of safety cones may be stacked for easy storage without first having to remove the caution tape holders attached thereto. Finally, there is a long-felt need for a caution tape holder that accomplishes all of the forgoing objectives and that is relatively inexpensive to manufacture, and safe and easy to use.

SUMMARY

The following presents a simplified summary in order to provide a basic understanding of some aspects of the disclosed innovation. This summary is not an extensive overview, and it is not intended to identify key/critical elements or to delineate the scope thereof. Its sole purpose is to present some concepts in a simplified form as a prelude to the more detailed description that is presented later.

The subject matter disclosed and claimed herein, in one aspect thereof, is a caution tape holder for removable attachment to a safety cone wherein neither the safety cone, the device nor the caution tape is damaged during installation or removal. In a preferred embodiment of the present invention, the caution tape holder is comprised of an integrally formed top and body portions, wherein said top portion further comprises an opening and a slot for receipt of a length of prior art caution tape, and wherein said body portion is further comprised of a plurality of ridges and valleys for removably insertion into an opening in a safety cone or other object.

The caution tape holder of the present invention permits a user to removably attach the holder and other items, such as caution tape, warning flags and the like, to a prior art safety cone. Proper use of the caution tape holder will not result in damage to the caution tape, the caution tape holder, or to the safety cone to which they are attached, thereby enabling the reuse of said items. The unique design and profile of the caution tape holder also permits the safety cones to be stacked on top of one another for relatively easy storage with the caution tape holder installed thereon. Finally, the caution tape holder of the present invention is relatively inexpensive to manufacture, and safe and easy to use.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and is intended to include all such aspects and their equivalents. Other advantages and novel features will become apparent from the following detailed description when considered in conjunction with the drawings.

DETAILED DESCRIPTION

Figure 1:
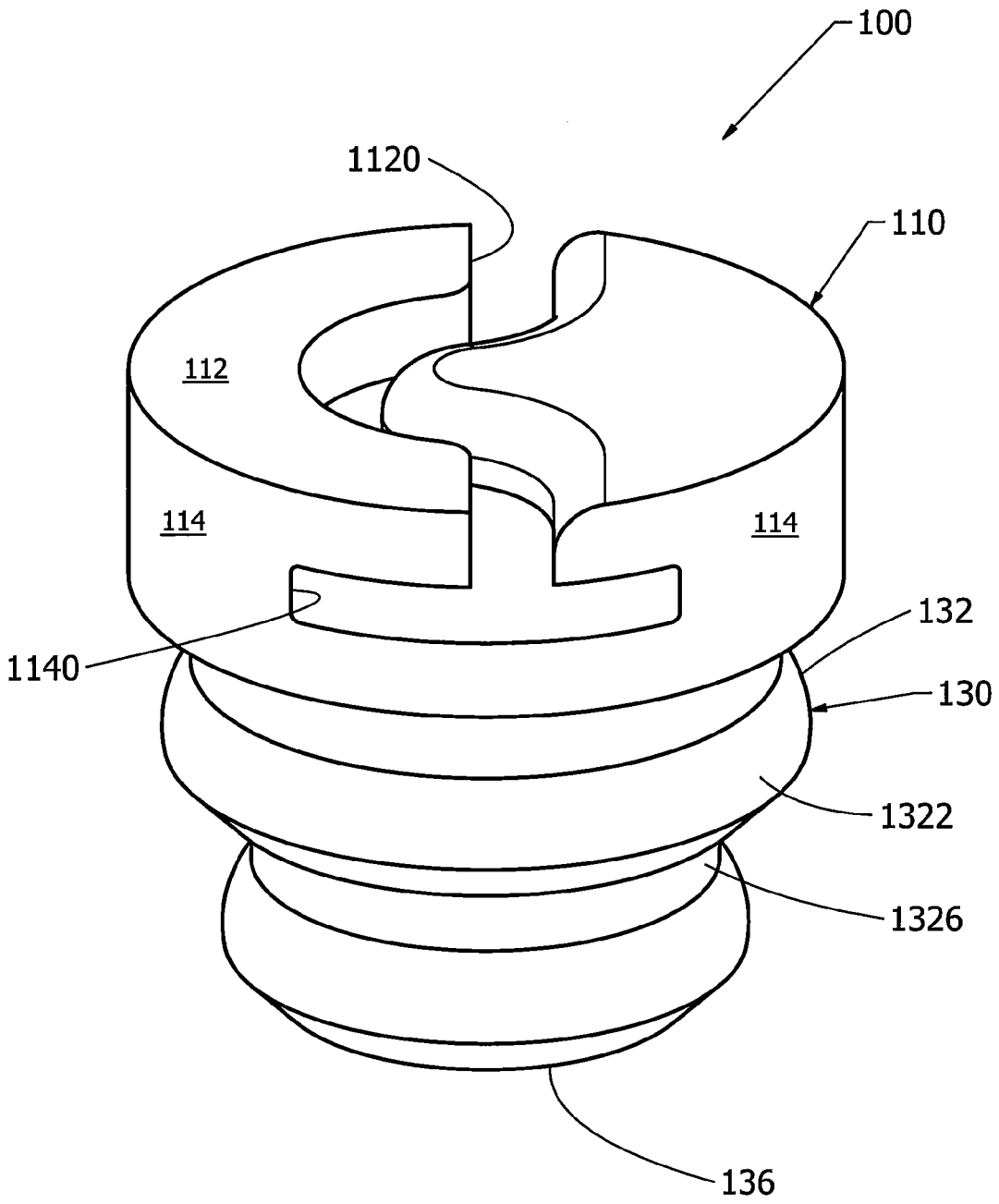
FIG. 1 illustrates a perspective view of a preferred embodiment of the caution tape holder of the present invention.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details.

Referring initially to the drawings, FIG. 1 illustrates a perspective view of a preferred embodiment of caution tape holder 100 of the present invention. Holder 100 is comprised of a top portion 110 and a body portion 130, wherein said top and body portions 110, 130 are preferably integrally formed. Nonetheless, it is also contemplated that top portion 110 and body portion 130 may be two separate components, fixedly or removably attached to each other by any common means known in the art. Inasmuch as the holder is typically deployed outdoors and exposed to the elements such as rain, snow, sleet, etc., holder 100 is preferably comprised of ABS (acrylonitrile-butadiene-strene) plastic or some other generally weather-resistant material such as plastic, aluminum, wood, rubber, or the like.

In a preferred embodiment of the present invention, top portion 110 is generally cylindrical in shape and further comprised of a top surface 112, a side surface 114, and a bottom surface 116. The thickness of top portion 110, as measured between top surface 112 and bottom surface 114 is preferably between 7/16ths and ¾ inches, and the overall diameter of top portion 110 is preferably between 1⅝ths and 2 inches. Nonetheless, it is also contemplated that other shapes and dimensions could also be utilized without affecting the overall concept of the present invention, provided that the shape and/or size of top portion 110 is such that top portion 110 is not permitted to pass through an opening 230 in a prior art safety cone 200.

As best illustrated in FIG. 1, top surface 112 of top portion 110 is preferably comprised of an opening 1120 therein that leads to a slot 1140 formed in side surface 114 of top portion 110. More specifically, and as described more fully below, a length of prior art caution tape 250 can be passed through opening 1120 and removably retained in slot 1140 without damaging tape 250. While the overall shape and dimensions of opening 1120 and slot 1140 may vary to suit user need and/or preference, in a preferred embodiment of the present invention the width of opening 1120 will be less than the width of slot 1140 to reduce the likelihood that caution tape 250 will prematurely detach from holder 100. For example, the width of opening 1120 is preferably between 3/16ths and 5/16ths of an inch, and the width of slot 1140 is preferably between ⅞ths and one inch. Opening 1120 may also have a generally curved appearance, as shown in FIG. 1, to further reduce the likelihood that caution tape 250 will become prematurely or unintentionally detached from holder 100.

Figure 2:
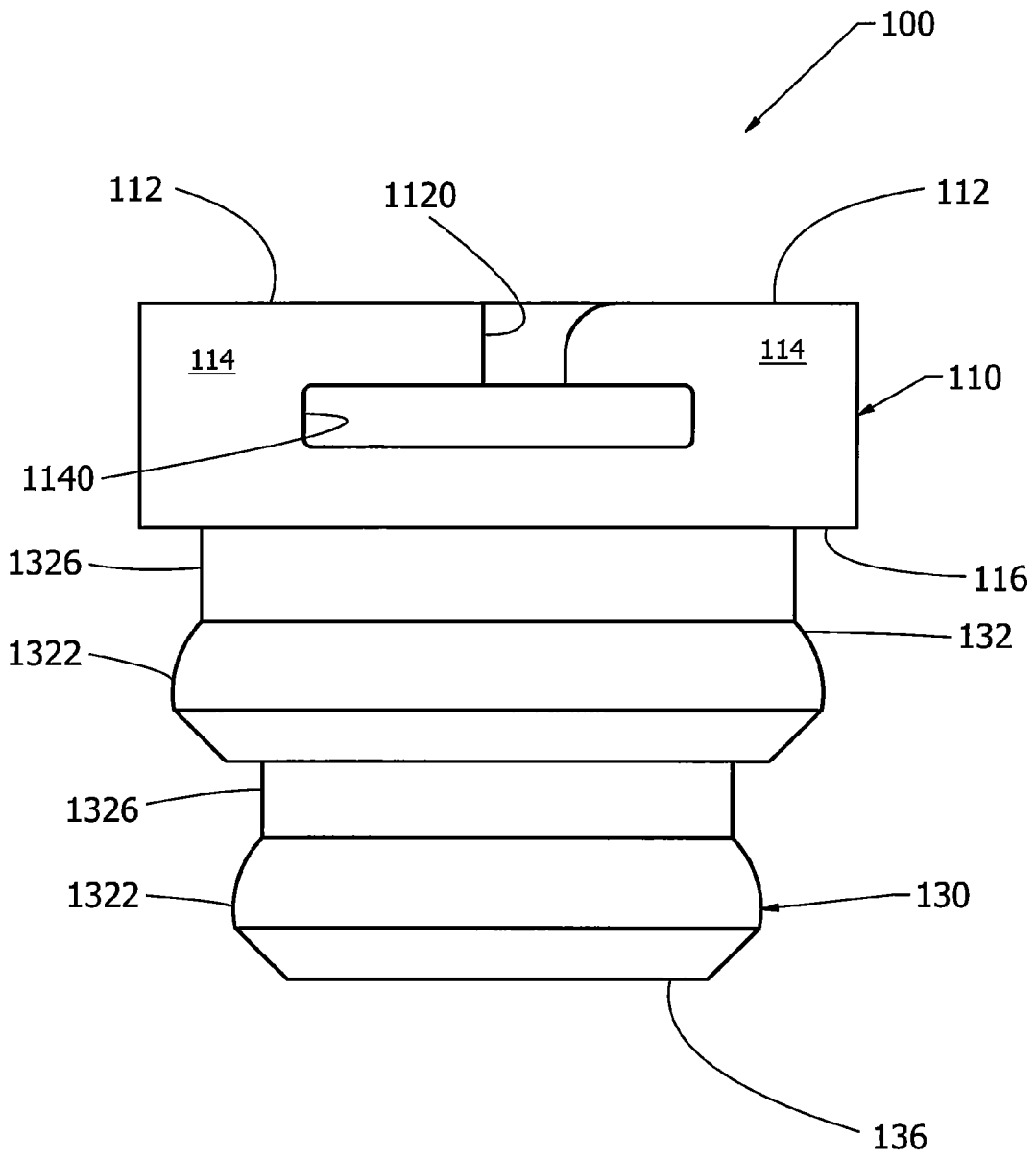
FIG. 2 illustrates a front elevational view of the preferred embodiment of the caution tape holder of the present invention.

As illustrated in FIGS. 1 and 2, body portion 130 is a generally conically-shaped mass comprised of an outer surface 132 and a bottom 136 located opposite of top portion 110. Body portion 130 may be a solid mass or hollowed out. For example, bottom 136 may have an opening (not shown) therein to reduce the overall weight of holder 100.

In a preferred embodiment of the present invention, outer surface 132 is further comprised of more than one ridge 1322 and more than one valley 1326, wherein the diameter of each ridge 1322 and valley 1326 is less than the diameter of top portion 110 and decreases in size along outer surface 132 in the direction of bottom 136. For example, the outside diameter of the valley 1326 nearest top portion 110 is preferably between 1¼ and 1⅝ths inches, whereas the outside diameter of the adjacent valley 1326 closer to bottom 136 is preferably between 1 1/16th and 1¼ inches and less than the diameter of the previous valley 1326 near top portion 110. Likewise, and by way of example, the outside diameter of the ridge 1322 nearest top portion 110 is preferably between 1⅜ths and 1⅝ths inches, whereas the outside diameter of the adjacent ridge 1322 closer to bottom 136 is preferably between 1 5/16ths and 1 9/16ths inches and less than the diameter of the previous ridge 1322 near top portion 110.

Figure 3:
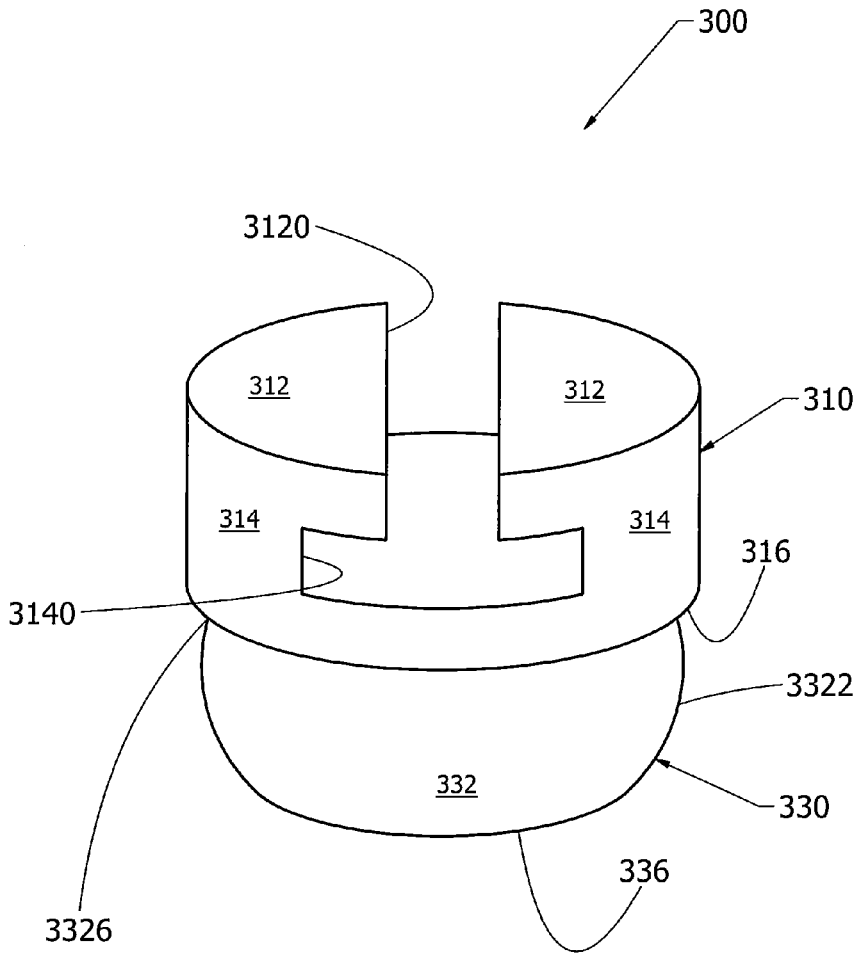
FIG. 3 illustrates a perspective view of an alternative embodiment of the caution tape holder of the present invention.

As described more fully below, most prior art safety cones 200 have an opening 230 that is either 1 1/16th or 1 5/16th inches in diameter. Accordingly, in a more preferred embodiment of the present invention, body portion 130 has two ridges 1322 of differing and decreasing diameters to accommodates the two different standard sizes of openings 230 in prior art safety cones 200. Nonetheless, it is contemplated that body portion 130 could also have more or less ridges 1322 and valleys 1326 to suit user preference and/or a particular application without affecting the overall concept of the present invention. Indeed, FIG. 3 depicts an alternative embodiment of holder 300 comprised of a top portion 310 and a bottom portion 330. Similar to the holder depicted in FIGS. 1 and 2, top portion 310 is further comprised of a top surface 312, a side surface 314, and a bottom surface 316. The thickness of top portion 310, as measured between top surface 312 and bottom surface 314 is preferably between 7/16ths and ¾ of an inch, and the overall diameter of top portion 310 is preferably between 1 5/16ths and 1⅝ths inches. Nonetheless, it is also contemplated that other shapes and dimensions could also be utilized without affecting the overall concept of the present invention, provided that the shape and/or size of top portion 310 is such that top portion 310 is not permitted to pass through opening 230 in a prior art safety cone 200.

Top surface 312 of top portion 310 is preferably comprised of an opening 3120 therein that leads to a slot 3140 formed in side surface 314 of top portion 310. More specifically, and as described above, a length of prior art caution tape 250 can be passed through opening 3120 and removably retained in slot 3140 without damaging tape 250. While the overall shape and dimensions of opening 3120 and slot 3140 may vary to suit user need and/or preference, in a preferred embodiment of the present invention the width of opening 3120 will be less than the width of slot 3140 to reduce the likelihood that caution tape 250 will prematurely detach from holder 300. For example, the width of opening 3120 is preferably between ¼ and ⅜ths of an inch, and the width of slot 3140 is preferably between ⅝ths and ⅞ths of an inch. Opening 3120 may also have a generally curved appearance (not shown) similar to that of holder 100 in FIG. 1 to further reduce the likelihood that caution tape 250 will become prematurely or unintentionally detached from holder 300.

As illustrated in FIG. 3, body portion 330 is a generally conically-shaped mass comprised of an outer surface 332 and a bottom 336 located opposite of top portion 310. Body portion 330 may be a solid mass or hollowed out. For example, bottom 336 may have an opening (not shown) therein to reduce the overall weight of holder 300.

Outer surface 332 is further comprised of a single ridge 3322 and at least one valley 3326, wherein the diameter of ridge 3322 and at least one valley 3326 are both less than the diameter of top portion 310. For example, the outside diameter of the at least one valley 3326 nearest top portion 310 is preferably between one and 1¼ inches, and the outside diameter of the ridge 3322 nearest top portion 310 is preferably between 1⅛th and 1⅜ths inches. Nonetheless, it is contemplated that other shapes and sizes could also be employed to suit user preference or a particular application, provided that head portion 310 is not permitted to pass through opening 230 in prior art cone 200.

Figure 4:
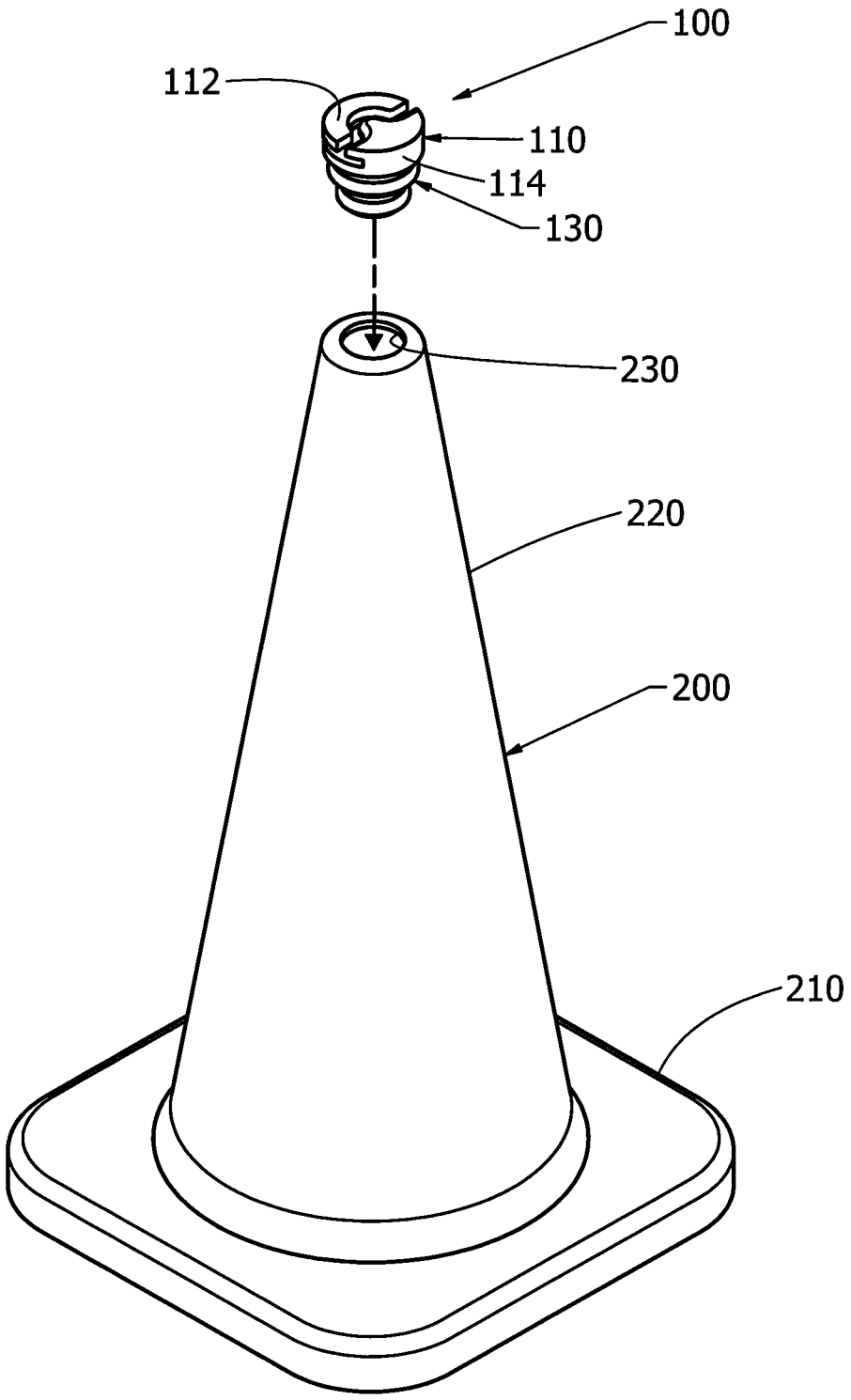
FIG. 4 illustrates a perspective view of the preferred embodiment of the caution tape holder of the present invention being inserted into a safety cone.

Having now described the overall structure of multiple embodiments of caution tape holder 100, 300, the general structure of prior art safety cone 200 and the use and usefulness of holder 100, 300 will now be summarized. FIG. 4 illustrates a perspective view of the preferred embodiment of the caution tape holder 100 of the present invention being inserted into safety cone 200. Safety cones 200 are well known in the art and are typically comprised of a base 210 for contacting the ground or other generally horizontal surface, a generally conically shaped body portion 220 that rests atop of base 210 and a generally circular opening 230 at the top of body portion 220. The two most common sizes of opening 230 in cone portion 220 are 1 1/16ths and 1 5/16th inches in diameter. Accordingly, as described above, the overall shape and size of holder 100 should be such that body portion 130 may be inserted into opening 230 to create a friction fit between the outer surface 132 of body portion 130 and cone body portion 220. More specifically, if safety cone 200 is of the type having an opening 230 with a diameter of approximately 1 1/16th inches (i.e., the smaller of the two most frequently used sized openings), only the smaller of the two ridges 1322 would fit within opening 230 and the larger of the two ridges 1322 (i.e., the one nearest top portion 110) would rest atop of cone body portion 220 above opening 230. By comparison, if safety cone 200 is of the type having an opening 230 with a diameter of approximately 1 5/16ths inches (i.e., the larger of the two most frequently used sized openings), both of ridges 1322 would fit within opening 230 and only the top portion 110 would rest atop of cone body portion 220 above opening 230. Consequently, it can be appreciated that the preferred embodiment of holder 100 can be used with either of the two most common types of prior art cones 200.

Figure 5:
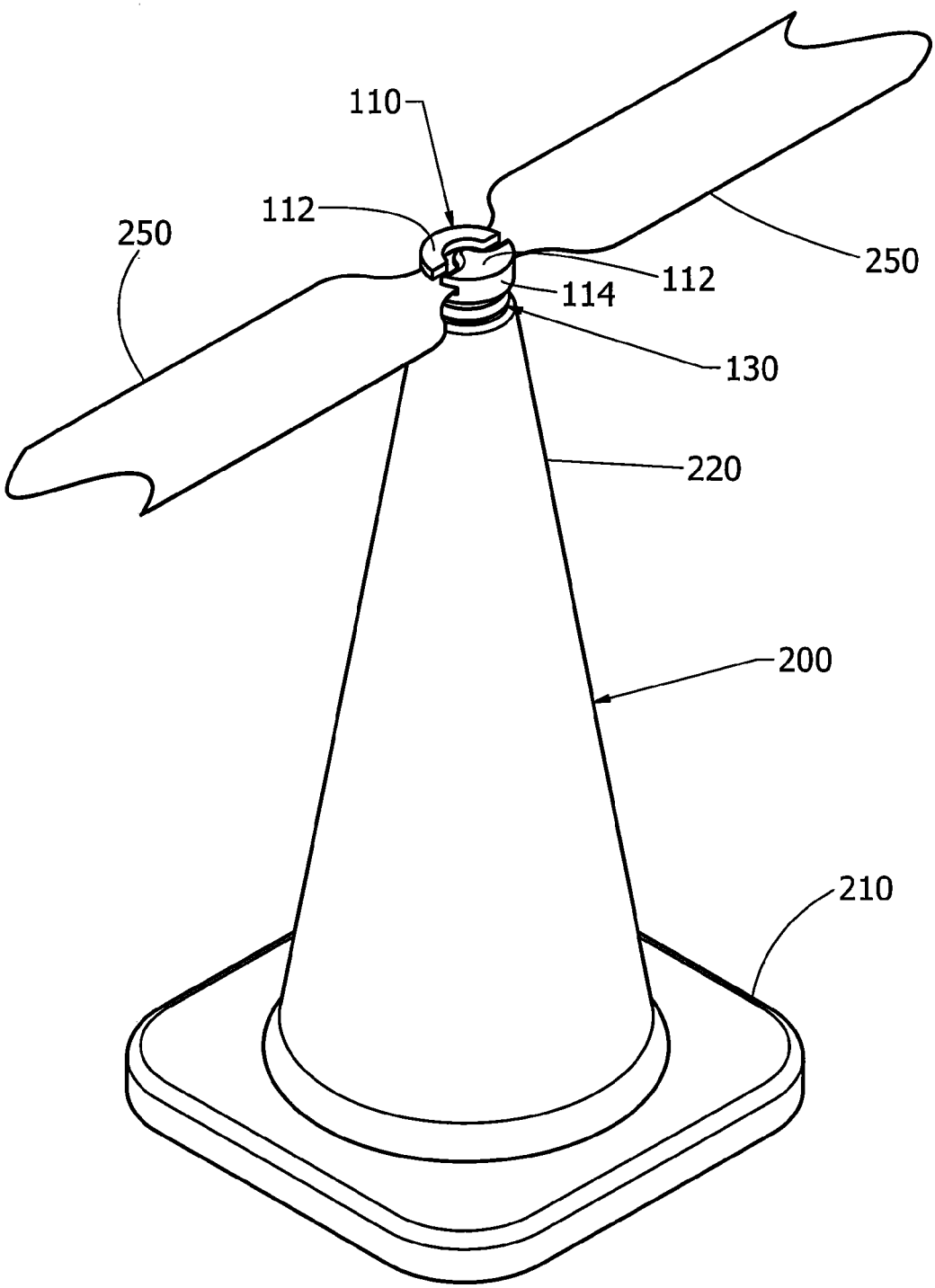
FIG. 5 illustrates a perspective view of the preferred embodiment of the caution tape holder of the present invention installed on a safety cone and supporting a length of caution tape.

Once holder 100 has been properly installed atop of prior art cone 200, a user (not shown) may removably attach a length of caution tape 250 to holder 100 by inserting tape 250 through opening 1120 in top surface 112 and into slot 1140, as best shown in FIG. 5. In this manner, caution tape 250 may be removably attached to a prior art safety cone 200 relatively quickly and easily, and without damaging tape 250 or cone 200. Further, in the preferred embodiment of the present invention depicted in FIG. 1, the width of opening 1120 is less than the width of slot 1140 to reduce the likelihood that caution tape 250 will prematurely detach from holder 100. In the same embodiment, opening 1120 also has a generally curved appearance across top surface 112 to further reduce the likelihood that caution tape 250 will become prematurely or unintentionally detached from holder 100.

Figure 6:
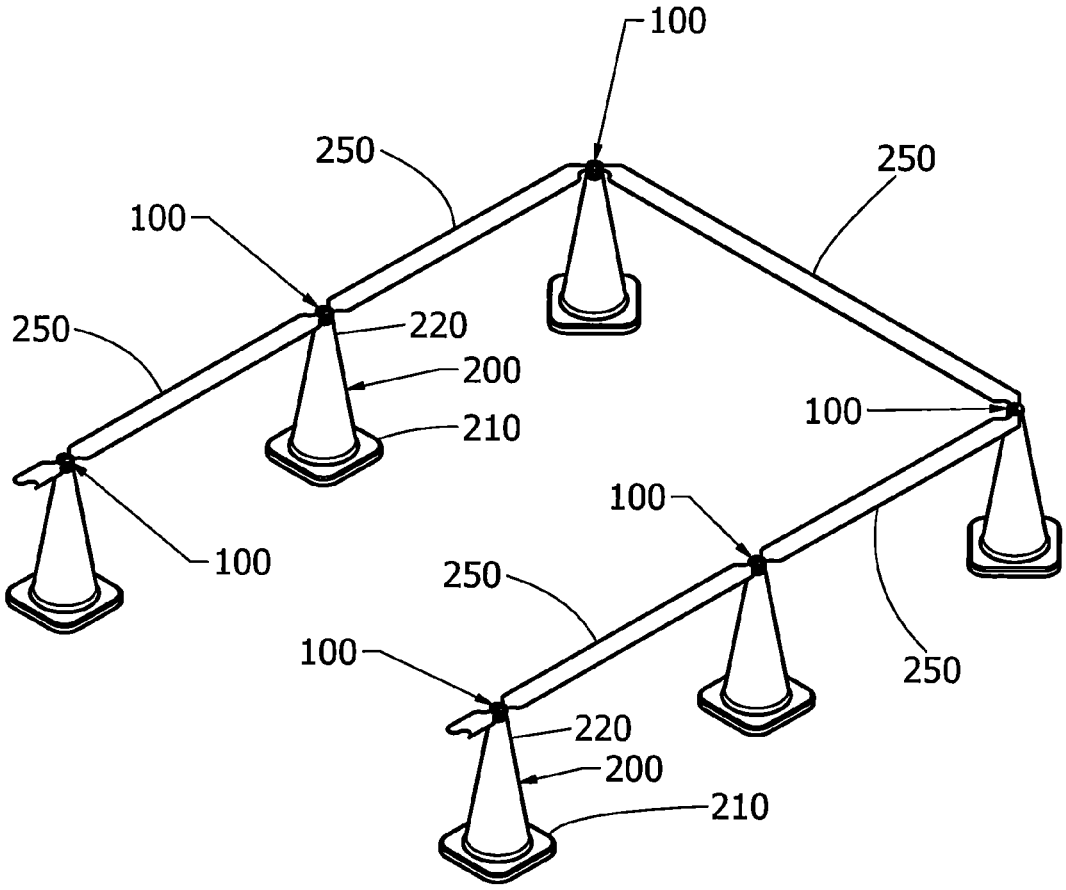
FIG. 6 illustrates a perspective view of a plurality of caution tape holders of the present invention installed on safety cones and cordoning off a safety zone.

FIG. 6 illustrates a perspective view of a plurality of caution tape holders 100 of the present invention installed on prior art safety cones 200 to cordon off a safety zone. As an important feature of the present invention, once the safety zone is no longer needed, a user (not shown) can quickly and easily remove tape 250 from slot 1140 via opening 1120 without damaging the tape 250 or the prior art cone 200, ensuring that both can be reused in the future.

Consequently, the various embodiments of caution tape holder 100 of the present invention permit a user to removably attach the holder 100, 300 and other items, such as caution tape 250, warning flags and the like, to a prior art safety cone 200 or other object with an opening therein. Proper use of the caution tape holder 100, 300 will not result in damage to the caution tape 250, holder 100, 300, or to the safety cone 200 to which they are attached, thereby enabling the reuse of said items. The unique design and profile of the caution tape holders 100, 300 described herein also permits the safety cones 200 to be stacked on top of one another for relatively easy storage with the caution tape holder 100 installed thereon. Finally, the caution tape holder 100, 300 of the present invention is relatively inexpensive to manufacture, and safe and easy to use.

Other variations are within the spirit of the present invention. Thus, while the invention is susceptible to various modifications and alternative constructions, a certain illustrated embodiment thereof is shown in the drawings and has been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Preferred embodiments of this invention are described herein. Variations of those preferred embodiments may become apparent to those of ordinary skill in the art upon reading the foregoing description. The inventor expects skilled artisans to employ such variations as appropriate, and the inventor intends for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A caution tape holder for attaching a length of caution tape to a safety cone with an opening in said safety cone comprising:

a top portion further comprising a top surface with an opening therein for receipt of said length of caution tape, wherein said opening in said top surface is non-linear and extends across the entire top surface; and a bottom portion, wherein said bottom portion further comprises at least one ridge and at least two valleys and at least a portion of said bottom portion is inserted within said opening in said safety cone.

2. The caution tape holder of claim 1 wherein said bottom portion further comprises a second ridge.

3. The caution tape holder of claim 2 wherein said second ridge is larger in size than at least one of said at least one ridge.

4. A caution tape holder for attaching a length of caution tape to a safety cone with an opening therein comprising:

a top portion with an opening and a slot formed therein, wherein said opening is formed along an entire length of a top surface of said top portion; and a bottom portion, wherein said bottom portion is further comprised of at least two ridges and at least one valley.

5. The caution tape holder of claim 4 wherein said opening is in communication with said slot to permit said length of caution tape to pass through said opening in the top surface and into said slot.

6. The caution tape holder of claim 4 wherein said opening in the top surface is non-linear.

7. The caution tape holder of claim 4 wherein said slot is wider than said opening in said top surface.

8. The caution tape holder of claim 4 wherein said bottom portion is comprised of a second valley.

9. The caution tape holder of claim 4 wherein at least one of said at least two ridges is smaller in size than another one of said at least two ridges.

10. A tape holder for attaching a length of tape to an object with an opening therein comprising:

a top portion, wherein said top portion is larger than and incapable of passing through said opening in the object and further wherein said top portion further comprises a top surface with an opening therein and a slot for receipt of said length of tape; and a bottom portion, wherein said bottom portion is further comprised of at least two ridges and at least two valleys.

11. The tape holder of claim 10 wherein said slot is wider than said opening in said top portion.

12. The tape holder of claim 10 wherein at least a portion of said bottom portion is inserted into the opening in the object.

13. The tape holder of claim 10 wherein at least one of said at least two ridges is smaller in size than another one of said at least two ridges.

14. The tape holder of claim 10 wherein said top portion rests upon the object above said opening in the object.

* * * * *